US007213608B1

(12) United States Patent
Chen et al.

(10) Patent No.: US 7,213,608 B1
(45) Date of Patent: May 8, 2007

(54) WASTED WATER DRAINING VALVE FOR A DRINKING WATER FOUNTAIN

(76) Inventors: Jui-Chien Chen, 321, Sec. 4, Lu He Rd., Lu Gang, Changhua Hsien (TW); Jui-Ching Chen, 321, Sec. 4, Lu He Rd., Lu Gang, Changhua Hsien (TW)

( * ) Notice: Subject to any disclaimer, the term of this patent is extended or adjusted under 35 U.S.C. 154(b) by 47 days.

(21) Appl. No.: 10/999,303

(22) Filed: Nov. 29, 2004

(51) Int. Cl.
*E03C 1/00* (2006.01)

(52) U.S. Cl. ..... 137/216; 137/678; 137/695; 137/801

(58) Field of Classification Search ..... 251/118, 251/127; 137/215–218
See application file for complete search history.

(56) References Cited

U.S. PATENT DOCUMENTS 2,196,301 A * 4/1940 Heine ..... 4/624
2,481,662 A * 9/1949 Hastings ..... 62/391
3,183,923 A * 5/1965 Henrikson ..... 137/216
3,512,545 A * 5/1970 Weaver ..... 137/216
3,901,440 A * 8/1975 Baker ..... 239/28
4,600,148 A * 7/1986 Raymer et al. ..... 239/29.3
4,804,010 A * 2/1989 Meissenburg ..... 137/216
4,924,812 A * 5/1990 Bernays, Jr. ..... 119/76
4,967,784 A * 11/1990 Barhydt et al. ..... 137/216
5,875,809 A * 3/1999 Barrom ..... 137/216
6,510,863 B1 * 1/2003 Traylor ..... 137/216

* cited by examiner

*Primary Examiner*—J. Casimer Jacyna
(74) *Attorney, Agent, or Firm*—Alan D. Kamrath; Nikolai & Mersereau, P.A.

(57) ABSTRACT

A wasted water draining valve for a drinking water fountain includes a valve body having a bottom having a first side formed with a wasted water inlet channel and a second side formed with a wasted water outlet channel connected to the inlet channel. Thus, the wasted water inlet channel of the valve body is inclined relative to the wasted water outlet channel, so that the wasted water inlet channel of the valve body is directly connected to the wasted water outlet channel without having to provide a U-shaped tube to connect the wasted water inlet channel and the wasted water outlet channel of the valve body, thereby decreasing costs of fabrication.

2 Claims, 5 Drawing Sheets

WASTED WATER DRAINING VALVE FOR A DRINKING WATER FOUNTAIN

BACKGROUND OF THE INVENTION

1. Field of the Invention

The present invention relates to a wasted water draining valve, and more particularly to a wasted water draining valve for a drinking water fountain.

2. Description of the Related Art

A conventional wasted water draining valve for a drinking water fountain in accordance with the prior art shown in FIGS. 4 and 5 comprises a valve body 10, a U-shaped tube 40, a threaded plug 50, a wasted water inlet tube 20, and a wasted water outlet tube 30. The valve body 10 has an inside formed with an inlet channel 12 having a lower end formed with an inlet hole 14 and an outlet channel 13 parallel with the inlet channel 12 and having a lower end formed with an outlet hole 15. The valve body 10 has a top formed with a threaded receiving recess 11 communicating with the inlet channel 12 and the outlet channel 13. The outlet channel 13 of the valve body 10 has a side formed with an air vent 16. The U-shaped tube 40 is mounted in the receiving recess 11 of the valve body 10 and has a first end secured to the inlet channel 12 of the valve body 10 and a second end secured to the outlet channel 13 of the valve body 10. The threaded plug 50 is screwed into the receiving recess 11 of the valve body 10. The wasted water inlet tube 20 has an upper end connected to the inlet hole 14 of the inlet channel 12 of the valve body 10 and a lower end connected to a first pipe (not shown) which is connected to a reverse osmosis device (not shown). The wasted water outlet tube 30 has an upper end connected to the outlet hole 15 of the outlet channel 13 of the valve body 10 and a lower end connected to a second pipe (not shown) which is connected to a drainage (not shown).

As shown in FIG. 5, the wasted water in turn passes through the wasted water inlet tube 20, the inlet channel 12 of the valve body 10, the U-shaped tube 40, the outlet channel 13 of the valve body 10 and the wasted water outlet tube 30 and finally flows outward from the wasted water outlet tube 30. Thus, the wasted water filtered by the reverse osmosis device enters the wasted water inlet tube 20, then flows upward into the wasted water draining valve of the drinking water fountain and is finally drained outward from the wasted water outlet tube 30, thereby preventing the wasted water from flowing back into the reverse osmosis device.

However, the conventional wasted water draining valve has a complicated construction, thereby increasing costs of fabrication. In addition, the air vent 16 is directly located at a side of the outlet channel 13 of the valve body 10, so that the wasted water easily sputters outward from the air vent 16 during drainage.

SUMMARY OF THE INVENTION

The primary objective of the present invention is to provide a wasted water draining valve for a drinking water fountain, wherein the wasted water draining valve has a simplified construction.

Another objective of the present invention is to provide a wasted water draining valve, wherein the wasted water inlet channel of the valve body is inclined relative to the wasted water outlet channel of the valve body, so that the wasted water inlet channel of the valve body is directly connected to the wasted water outlet channel of the valve body without having to provide a coupler (or U-shaped tube) to connect the wasted water inlet channel and the wasted water outlet channel of the valve body, thereby decreasing costs of fabrication.

A further objective of the present invention is to provide a wasted water draining valve, wherein the wasted water outlet channel of the valve body has an oblique air vent, thereby preventing the wasted water from sputtering outward from the air vent during drainage.

Further benefits and advantages of the present invention will become apparent after a careful reading of the detailed description with appropriate reference to the accompanying drawings.

DETAILED DESCRIPTION OF THE INVENTION

Figure 1:
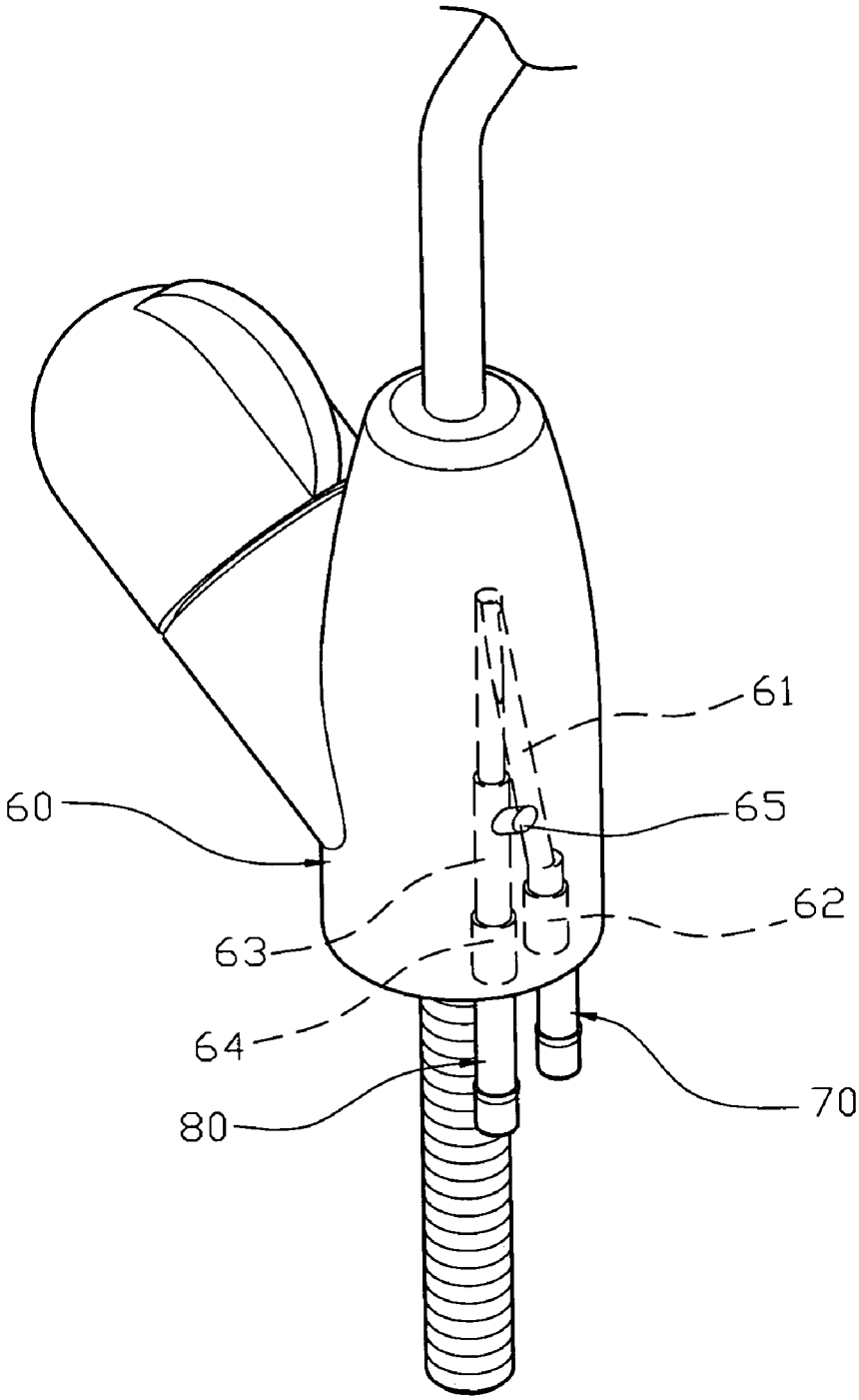
FIG. 1 is a perspective view of a wasted water draining valve for a drinking water fountain in accordance with the preferred embodiment of the present invention.
Figure 2:
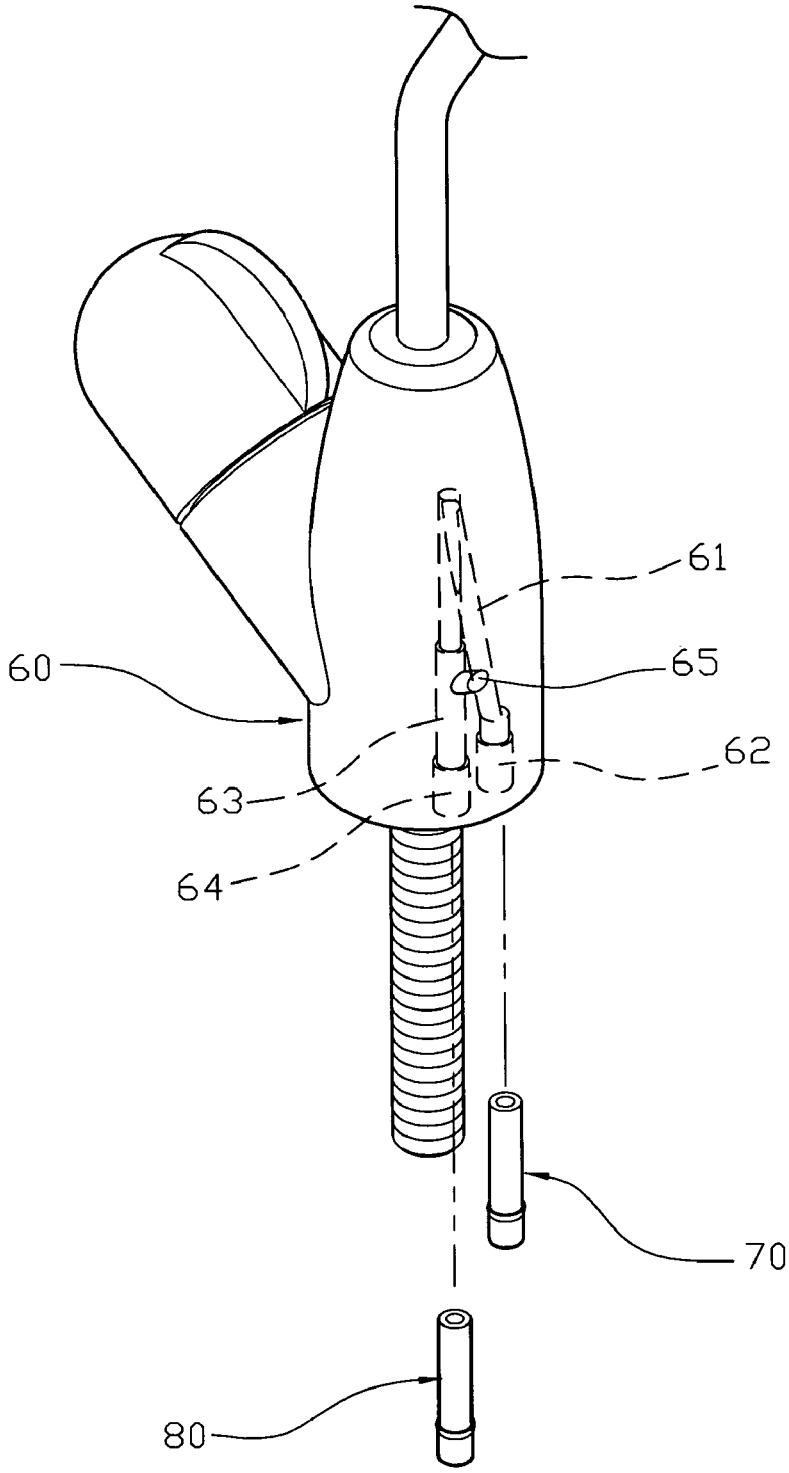
FIG. 2 is an exploded perspective view of the wasted water draining valve as shown in FIG. 1.

Referring to the drawings and initially to FIGS. 1 and 2, a wasted water draining valve for a drinking water fountain in accordance with the preferred embodiment of the present invention comprises a valve body 60, a wasted water inlet tube 70, and a wasted water outlet tube 80.

The valve body 60 has a bottom having a first side formed with a wasted water inlet channel 61 and a second side formed with a wasted water outlet channel 63 connected to the wasted water inlet channel 61.

The wasted water inlet channel 61 of the valve body 60 is inclined relative to the wasted water outlet channel 63 of the valve body 60. Preferably, the wasted water inlet channel 61 of the valve body 60 is disposed at an inclined state and the wasted water outlet channel 63 of the valve body 60 is disposed at an upright state. Alternatively, the wasted water inlet channel 61 of the valve body 60 is disposed at an upright state and the wasted water outlet channel 63 of the valve body 60 is disposed at an inclined state. Alternatively, the wasted water inlet channel 61 of the valve body 60 is disposed at an inclined state and the wasted water outlet channel 63 of the valve body 60 is disposed at an inclined state.

The wasted water outlet channel 63 of the valve body 60 has a diameter greater than that of the wasted water inlet channel 61 of the valve body 60.

The wasted water outlet channel 63 of the valve body 60 has a side formed with an oblique air vent 65 directed upward in an inclined manner and connected to an ambient environment to connect the wasted water outlet channel 63 of the valve body 60 to the ambient environment.

The wasted water inlet channel 61 of the valve body 60 has a lower end formed with a wasted water inlet hole 62, and the wasted water outlet channel 63 of the valve body 60 has an upper end connected to an upper end of the wasted water inlet channel 61 of the valve body 60 and a lower end formed with a wasted water outlet hole 64.

The wasted water inlet tube 70 has an upper end connected to the wasted water inlet hole 62 of the wasted water inlet channel 61 of the valve body 60 and a lower end connected to a first pipe (not shown) which is connected to a reverse osmosis device (not shown).

The wasted water outlet tube 80 has an upper end connected to the wasted water outlet hole 64 of the wasted water outlet channel 63 of the valve body 60 and a lower end connected to a second pipe (not shown) which is connected to a drainage (not shown).

Figure 3:
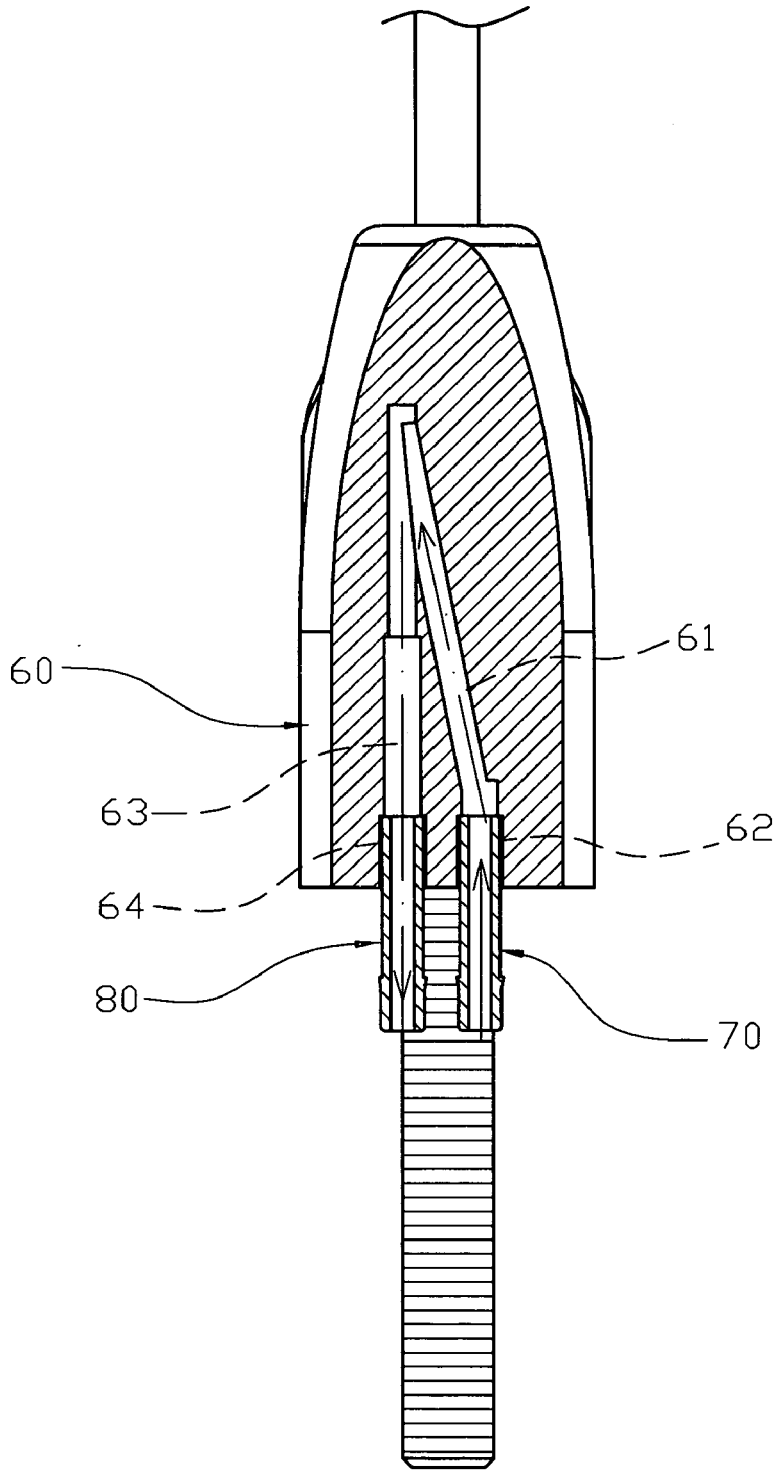
FIG. 3 is a plan cross-sectional view of the wasted water draining valve as shown in FIG. 1.
Figure 4:
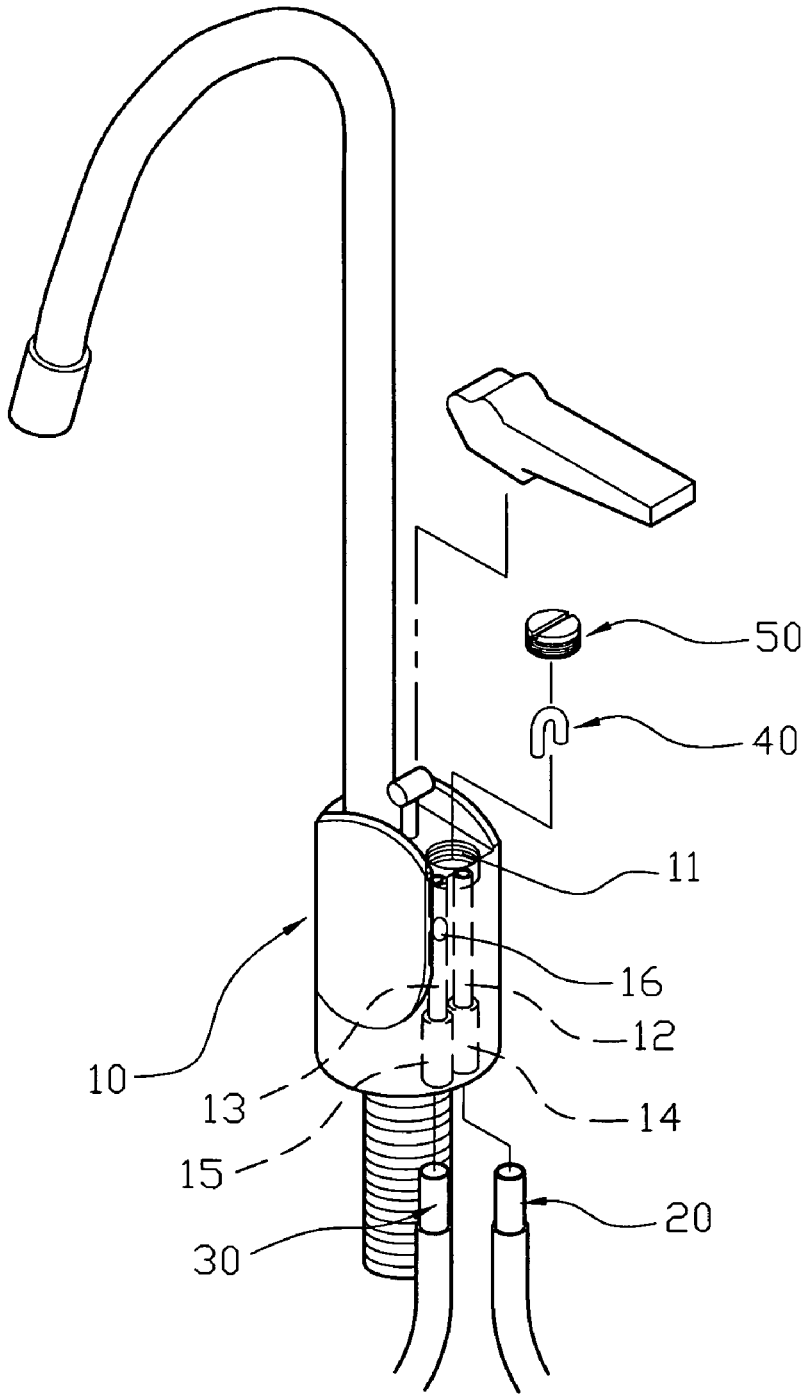
FIG. 4 PRIOR ART
FIG. 4 is an exploded perspective view of a conventional wasted water draining valve for a drinking water fountain in accordance with the prior art.
Figure 5:
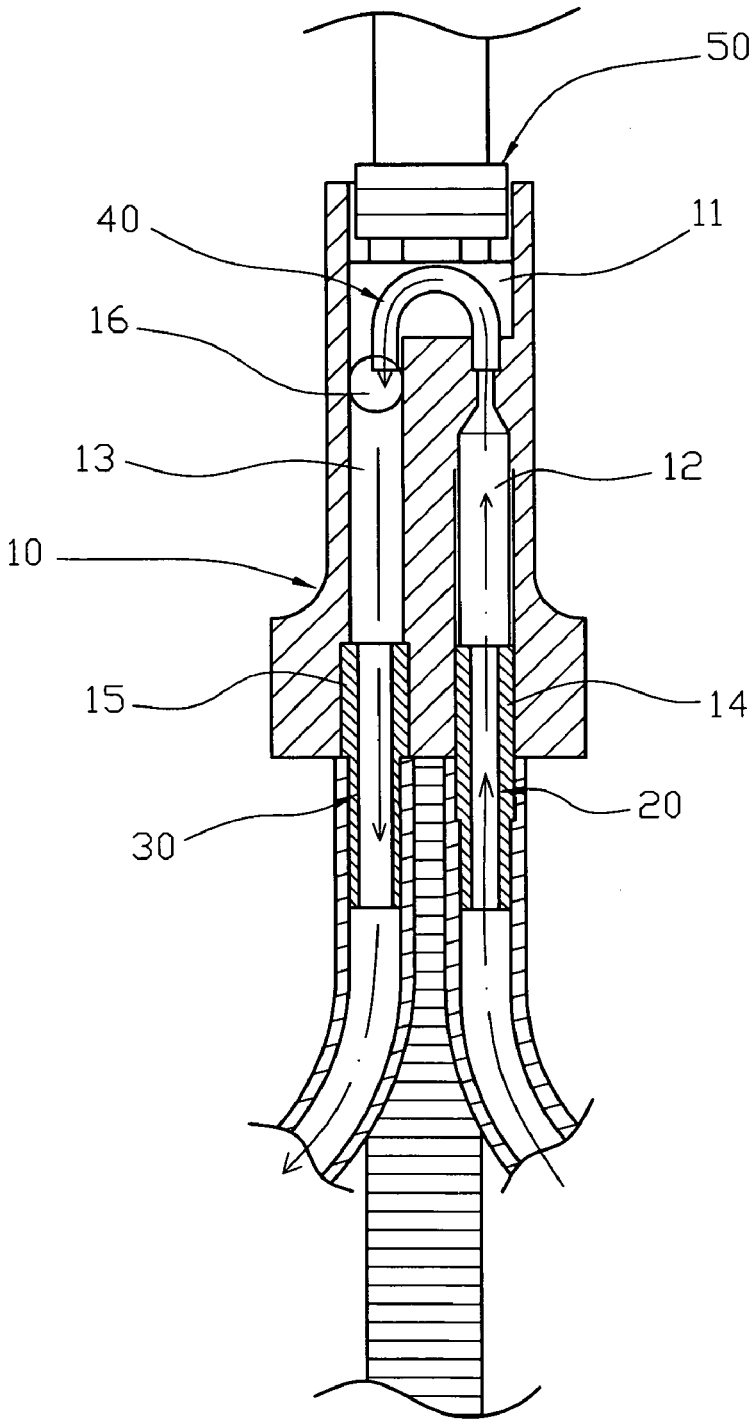
FIG. 5 PRIOR ART
FIG. 5 is a plan cross-sectional assembly view of the conventional wasted water draining valve as shown in FIG. 4.

As shown in FIGS. 1–3, the wasted water in turn passes through the wasted water inlet tube 70, the wasted water inlet channel 61 of the valve body 60, the wasted water outlet channel 63 of the valve body 60 and the wasted water outlet tube 80 and finally flows outward from the wasted water outlet tube 80.

Thus, the wasted water filtered by the reverse osmosis device enters the wasted water inlet tube 70, then flows upward into the wasted water draining valve of the drinking water fountain and is finally drained outward from the wasted water outlet tube 80, thereby preventing the wasted water from flowing back into the reverse osmosis device.

Accordingly, the wasted water inlet channel 61 of the valve body 60 is inclined relative to the outlet channel 63 of the valve body 60, so that the wasted water inlet channel 61 of the valve body 60 is directly connected to the wasted water outlet channel 63 of the valve body 60 without having to provide a coupler (or U-shaped tube) to connect the wasted water inlet channel 61 and the wasted water outlet channel 63 of the valve body 60, thereby decreasing costs of fabrication. In addition, the wasted water outlet channel 63 of the valve body 60 has an oblique air vent 65, thereby preventing the wasted water from sputtering outward from the air vent 65 during drainage.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wasted water draining valve, comprising:

a valve body having a bottom having a first side formed with a wasted water inlet channel and a second side formed with a wasted water outlet channel connected to the wasted water inlet channel, wherein:

the wasted water inlet channel of the valve body is inclined relative to the wasted water outlet channel of the valve body;

the wasted water inlet channel of the valve body is disposed at an inclined state and the wasted water outlet channel of the valve body is disposed at an inclined state;

the wasted water outlet channel of the valve body has an upper end connected to an upper end of the wasted water inlet channel of the valve body;

the wasted water inlet channel of the valve body has a lower end formed with a wasted water inlet hole, and the wasted water outlet channel of the valve body has a lower end formed with a wasted water outlet hole;

a wasted water inlet tube having an upper end connected to the wasted water inlet hole of the wasted water inlet channel of the valve body; and a wasted water outlet tube having an upper end connected to the wasted water outlet hole of the wasted water outlet channel of the valve body;

wherein the wasted water outlet channel of the valve body has a side formed with an oblique air vent directed upward in an inclined manner and connected to an ambient environment to connect the wasted water outlet channel of the valve body to the ambient environment to prevent wasted water in the wasted water outlet tube from flowing backward from the wasted water outlet channel of the valve body into the wasted water inlet channel of the valve body and the wasted water inlet tube and to prevent the wasted water from sputtering outward from the air vent during drainage.

2. The wasted water draining valve in accordance with claim 1, wherein the wasted water outlet channel of the valve body has a diameter greater than that of the wasted water inlet channel of the valve body.

* * * * *